US005163394A

United States Patent [19]

Koishikawa et al.

[11] Patent Number: 5,163,394

[45] Date of Patent: Nov. 17, 1992

[54] ENGINE WITH HORIZONTAL CYLINDERS AND OUTBOARD ENGINE ASSEMBLY HAVING SUCH ENGINE

[75] Inventors: Koji Koishikawa, Kanagawa; Wataru Simazaki; Kazuyoshi Sato, both of Saitama, all of Japan

[73] Assignee: Honda Giken Kabushiki Kaisha, Tokyo, Japan

[21] Appl. No.: 738,817

[22] Filed: Aug. 1, 1991

[30] Foreign Application Priority Data

Aug. 1, 1990 [JP] Japan ..... 2-205634

[51] Int. Cl.[5] ..... F01M 1/00

[52] U.S. Cl. ..... 123/196 W; 440/88

[58] Field of Search ..... 123/195 C, 195 HC, 195 P, 123/196 R, 196 V, 196 W, 198 E; 440/88, 900

[56] References Cited

U.S. PATENT DOCUMENTS 4,452,194 6/1984 Watanabe ..... 123/196 W 4,825,825 5/1989 Chino et al. ..... 123/196 W

FOREIGN PATENT DOCUMENTS 60-145209 9/1985 Japan .

*Primary Examiner*—Noah P. Kamen

*Attorney, Agent, or Firm*—Rosen, Dainow & Jacobs

[57] ABSTRACT

An engine for an outboard engine assembly includes a cylinder block with at least one horizontal cylinder defined therein, an oil pan disposed downwardly of the cylinder block, a cylinder head coupled to the cylinder block, and a head cover coupled to the cylinder head. The engine assembly also includes a valve operating mechanism chamber defined jointly between the cylinder head and the head cover, a lubricating oil supply passageway for supplying lubricating oil from the oil pan to at least the valve operating mechanism chamber, and a lubricating oil return passageway for returning lubricating oil from at least the valve operating mechanism chamber to the oil pan. The lubricating oil return passageway has openings for introducing lubricating oil from the valve operating mechanism chamber. The openings are defined in inner surfaces, respectively, of the cylinder head and the head cover which face a bottom of the valve operating mechanism chamber.

8 Claims, 8 Drawing Sheets

ENGINE WITH HORIZONTAL CYLINDERS AND OUTBOARD ENGINE ASSEMBLY HAVING SUCH ENGINE

BACKGROUND OF THE INVENTION

1. Field of the Invention

The present invention relates to an engine with horizontal cylinders, and more particularly to a lubricating oil passageway structure for an engine with horizontal cylinders and also to an outboard engine assembly which incorporates an engine with horizontal cylinders which has a lubricating oil passageway structure.

2. Description of the Prior Art

Engines with horizontal cylinders generally have lubricating oil supply and return passageways which interconnect a valve operating mechanism chamber defined between a cylinder head and a head cover, and an oil pan disposed in a lower portion of the engine.

Heretofore, as disclosed in Japanese Laid-Open Utility Model Publication No. 60-145209, the lubricating oil return passageway generally has an opening in a portion of the cylinder head which faces the bottom of the valve operating mechanism chamber, i.e., an inner bottom surface of the cylinder head which partly defines the valve operating mechanism chamber.

With the above disclosed lubricating oil return passageway, when the engine is tilted into a varied attitude, the distal ends of the horizontal cylinders may be displaced in a lower position, positioning the opening of the lubricating oil return passageway higher than the head cover portion that faces the bottom of the valve operating mechanism chamber. When such a positional displacement occurs, lubricating oil tends to remain trapped in the head cover portion lower than the opening of the lubricating oil return passage, and cannot fully be returned to the oil pan. Therefore, there has been a demand for an improvement in engines with horizontal cylinders to return the lubricating oil back to the oil pan.

SUMMARY OF THE INVENTION

In view of the aforesaid problems of the conventional lubricating oil return passageway, it is an object of the present invention to provide an engine with horizontal cylinders which has a lubricating oil passageway structure that prevents lubricating oil from remaining trapped in a head cover portion which faces the bottom of a valve operating mechanism chamber. That is, the passageway may be located in a lowermost position which allows the lubricating oil to return smoothly to an oil pan at all times, even when the engine is tiled into a varied attitude to shift distal end regions of the horizontal cylinders into a lower position. It is also an object of the present invention to provide an outboard engine assembly which incorporates such an engine with horizontal cylinders.

According to the present invention, there is provided an engine comprising a cylinder block with at least one horizontal cylinder defined therein, an oil pan disposed downwardly of the cylinder block, a cylinder head coupled to the cylinder block, a head cover coupled to the cylinder head, and a valve operating mechanism chamber defined jointly between the cylinder head and the head cover. The engine also comprises a lubricating oil supply passage means for supplying lubricating oil from the oil pan to at least the valve operating mechanism chamber, and lubricating oil return passage means for returning lubricating oil from at least the valve operating mechanism chamber to the oil pan. The lubricating oil return passage means having openings for introducing lubricating oil from the valve operating mechanism chamber, the openings being defined in inner surfaces, respectively, of the cylinder head and the head cover which face a bottom of the valve operating mechanism chamber.

The lubricating oil supply passage means comprises an oil suction pipe having an opening in the oil pan, and an oil pump for drawing lubricating oil from the oil pan through the oil suction pipe into the valve operating mechanism chamber. The lubricating oil return passage means comprises an oil return pipe communicating with the openings and has an opening disposed closely to the opening of the oil suction pipe in the oil pan.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
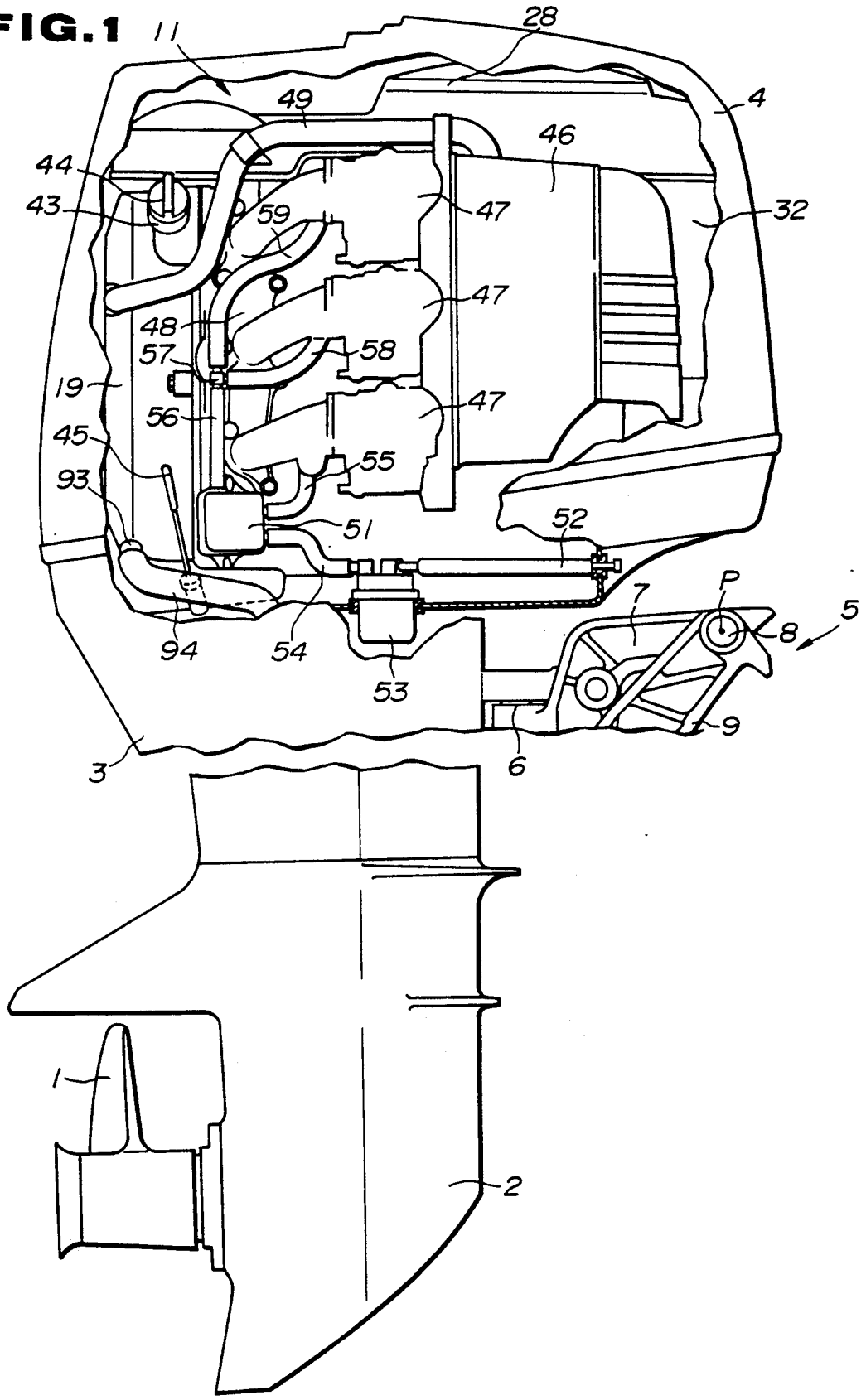
FIG. 1 is a fragmentary side elevational view, partly broken away, of an outboard engine assembly incorporating an engine with horizontal cylinders, the engine having a lubricating oil passageway structure according to the present invention.

In FIG. 1, an outboard engine assembly incorporates an engine with horizontal cylinders according to the present invention, with an engine cover omitted from illustration, the engine having a lubricating oil passageway structure.

The outboard engine assembly generally comprises a propeller screw 1, a gear case 2, an extension case 3, an engine cover 4, an attachment 5, and an engine 11.

The attachment 5 comprises a swivel case 7 coupled to the extension case 3 by a swivel joint 6, and a stern bracket 9 coupled to the swivel case 7 by a horizontal tilt pin 8. The stern bracket 9 is fixed to the stern of a boat (not shown). The outboard engine assembly is vertically swingable about an axis P of the horizontal tilt pin 8.

Figure 2:
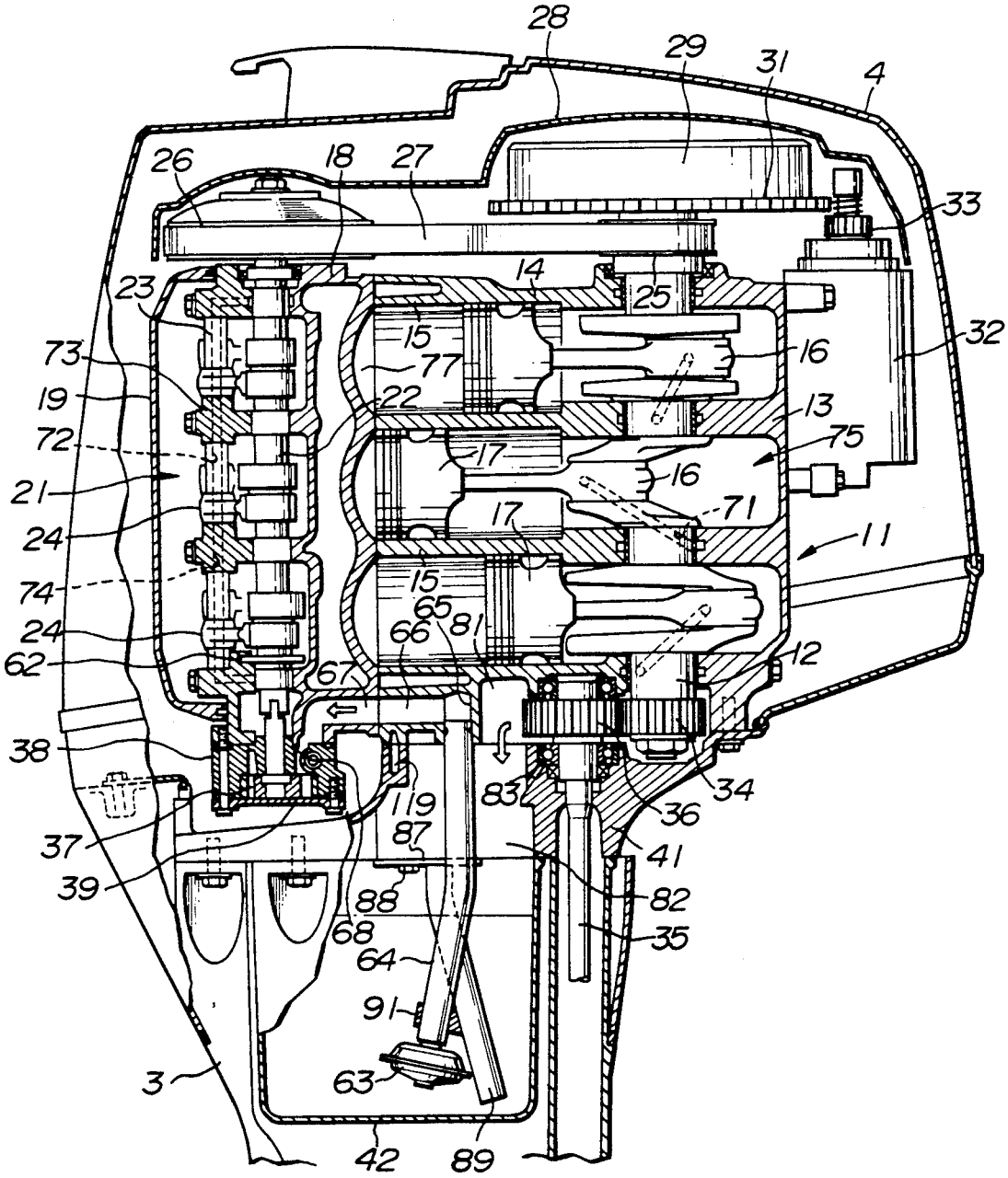
FIG. 2 is a vertical cross-sectional view of the engine, showing a portion of the lubricating oil passageway structure.
Figure 3:
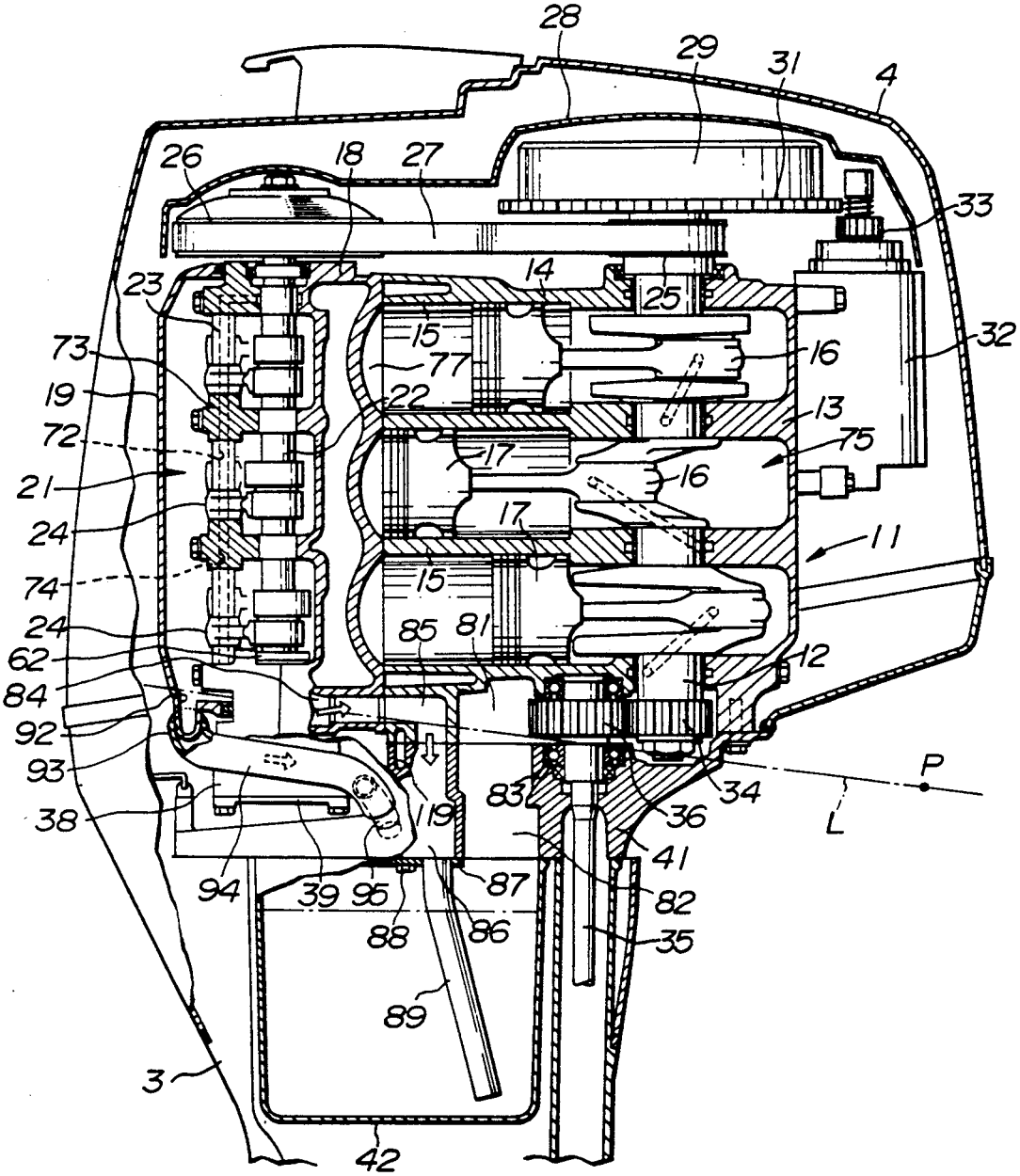
FIG. 3 is a vertical cross-sectional view of the engine, showing another portion of the lubricating oil passageway structure.

As also shown in FIGS. 2 and 3, the engine 11 has a vertical crankshaft 12 rotatably supported between joined regions of a crankcase 13 and a cylinder block 14. The cylinder block 14 has a vertical array of three cylinders 15 each extending horizontally. Each cylinder 15 houses a piston 17 slidably movable therein and operatively connected to the crankshaft 12 by a connecting rod 16.

A cylinder head 18 is joined to the cylinder block 14 remotely from the crankcase 13. A head cover 19 is joined to the cylinder head 18 remotely from the cylinder block 14. The cylinder head 18 and the head cover 19 jointly define a valve operating mechanism chamber 21 therebetween. In the valve operating mechanism chamber 21, there are vertically housed a camshaft 22 and a rocker shaft 23 with rocker arms 24 supported on the rocker shaft 23.

A timing belt 27 is trained around a drive pulley 25 on the upper end of the crankshaft 12 and around a driven pulley 26 on the upper end of the camshaft 22 in an upper portion of the engine 11. The timing belt 27 is covered with a timing belt cover 28. A flywheel 29 is mounted on the upper end of the crankshaft 12 above the drive pulley 25 in coaxial relationship thereto. The flywheel 29 has a driven gear 31 which can mesh with a drive gear 33 on the drive shaft of a starter motor 32 which is fixed to an outer wall of the crankcase 13.

An oil pump 37 is coupled to the lower end of the camshaft 22 in a lower portion of the engine 11. The oil pump 37 has a pump case 38 and a pump cover 39. A driven gear 34 mounted on the lower end of the crankshaft 12 is held in mesh with a driven gear 36 which is splined to the upper end of a vertical shaft 35. The vertical shaft 35 has an upper portion rotatably supported by a primary gear case 41 which is coupled to lower sides of the crankcase 13 and the cylinder block 14.

The vertical shaft 35 extends through the extension case 3 which is joined to a lower surface of the primary gear case 41. The vertical shaft 35 transmits drive power from the crankshaft 12 to the propeller screw 1 through a bevel gear assembly (not shown) in the gear case 2 which is coupled to the lower end of the extension case 3.

An oil pan 42 is joined to an outer lower surface of the primary gear case 41 within an upper portion of the extension case 3.

As shown in FIG. 1, the engine 11 also has an oil inlet 43, an oil cap 44, an oil level gage 45, an intake silencer 46, carburetors 47, an intake manifold 48, a breather pipe 49, and a fuel pump 51.

The oil inlet 43 projects from one side of an upper portion of the head cover 19, so that lubricating oil can be supplied without interference with the timing belt mechanism. The oil level gage 45 is located downwardly of the oil inlet 43, and extends into the oil pan 42 through an insertion hole (not shown) defined in the primary gear case 41. Since the oil inlet 43 and the oil level gage 45 are disposed on one side of the engine 11, lubricating oil can be supplied and the level of supplied lubricant oil can be checked on one side of the engine 11.

Fuel stored in a fuel tank (not shown) is drawn by the fuel pump 51 through a fuel supply pipe 52, a fuel filter 53, and a fuel supply pipe 54. The fuel is supplied from the fuel pump 51 to the lowermost carburetor 47 from a fuel supply pipe 55, and also to the middle and uppermost carburetors 47 from a fuel supply pipe 56, a T-shaped pipe 57, and fuel supply pipes 58, 59. The fuel pump 51 is mounted on one side of a lower portion of the cylinder head 18 (see FIG. 5), and positioned below the carburetors 47. This arrangement allows the fuel pump 51 to supply fuel without trapped air to the carburetors 47.

Figure 5:
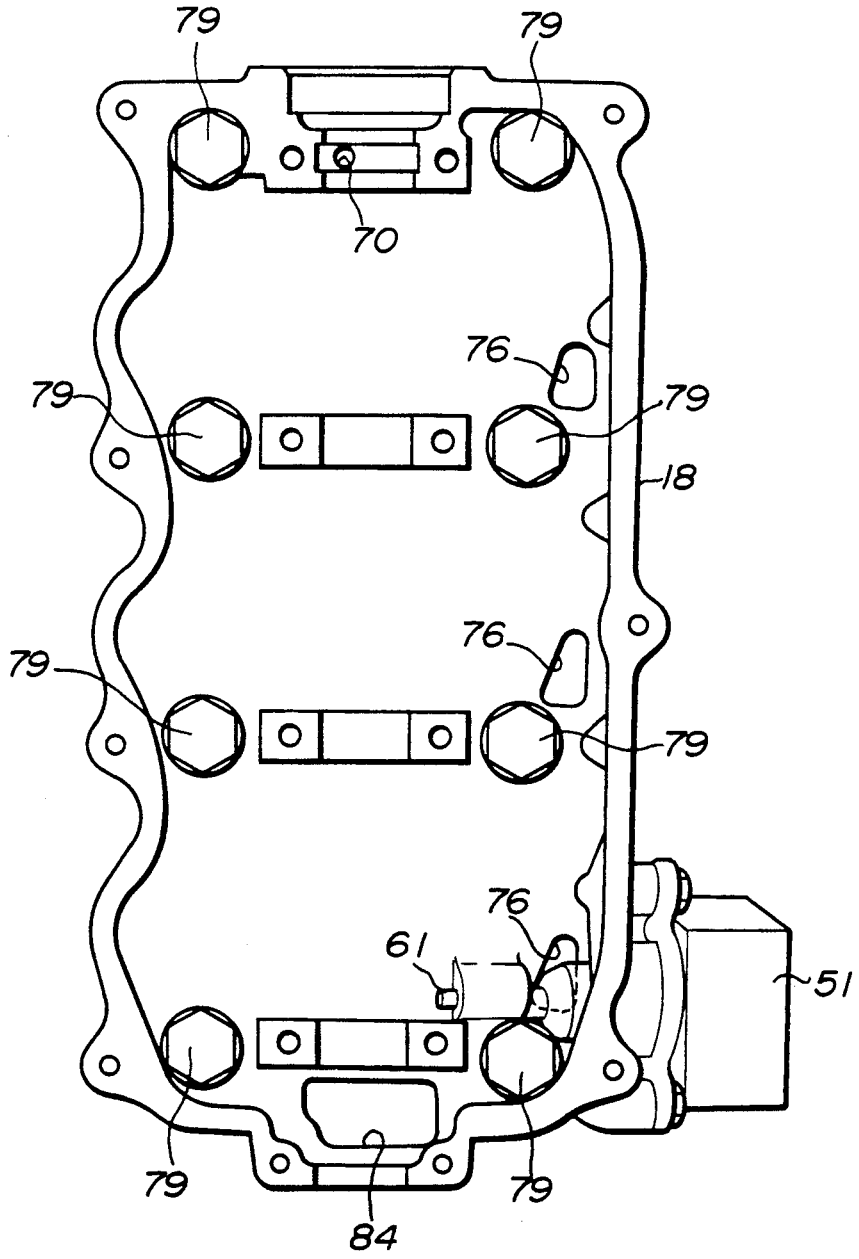
FIG. 5 is a plan view of the cylinder head, as viewed from a cylinder head cover.

The fuel pump 51 on one side of the lower portion of the cylinder head 18 comprises a diaphragm pump, and has a drive plunger 61 projecting into the cylinder head 18, as shown in FIG. 5. The drive plunger 61 is held against an eccentric cam 62 (see FIGS. 2 and 3) fixedly mounted on a lower end portion of the camshaft 22. When the eccentric cam 62 rotates with the camshaft 22, the drive plunger 61 moves back and forth to actuate the fuel pump 51.

A lubricating oil passage structure incorporated in the engine 11 will be described below.

As shown in FIG. 2, an oil suction pipe 64 has a lower open end opening toward the bottom of the oil pan 42 which is filled with lubricating oil, the lower open end being connected to an oil filter 63. The oil suction pipe 64 has an upper open end connected to an oil passage 65 which is defined in the cylinder block 14 and open in an outer lower surface of the cylinder block 14. The oil passage 65 communicates with an oil passage 66 which is defined in the cylinder block 14 and open at the mating surface of the cylinder block 14 which is held in mating engagement with the cylinder head 18. The oil passage 66 communicates with an oil passage 67 (see FIG. 4) which is defined in the cylinder head 18 and open at the mating surface of the cylinder head 18 which is held in mating engagement with the cylinder block 14. The oil passage 67 is also open at a lower surface of the cylinder head 18 and connected to a suction port 68 of the oil pump 37.

The oil pump 37 has an outlet port 114 (FIG. 8) connected to an oil passage 69 (FIG. 4) that is defined in the cylinder head 18 and open at the mating surface of the cylinder head 18 which is held in mating engagement with the cylinder block 14. The oil passage 69 is connected to an oil passage (not shown) which is defined in the cylinder block 14 and open at the mating surface of the cylinder block 14 which is held in mating engagement with the cylinder head 18. The non-illustrated oil passage communicates with a main gallery (not shown) defined in the cylinder block 14. The main gallery has a branch communicating with an oil passage 70 (see FIG. 5) which is open in a bearing by which the upper end of the camshaft 22 is rotatably supported.

The oil passage 70 supplies lubricating oil into an oil passage 72 defined in the rocker shaft 23 and an oil passage 74 defined in a holder 73 by which the rocker shaft 23 is supported.

The lubricating oil from the oil passage 69 is also supplied via the main gallery to an oil passage 71 that is defined in the crankshaft 12, through an oil passage (not shown) in the cylinder block 14.

The valve operating mechanism chamber 21 and a crankshaft chamber 75 in the crankcase 13 and the cylinder block 14 are therefore supplied with lubricating oil through the lubricating oil supply passageway thus defined.

The crankshaft chamber 75 and the valve operating mechanism chamber 21 are held in communication with each other through breather passages (not shown) defined in the cylinder block 14 and breather passages 76 (see FIGS. 4 and 5) defined in the cylinder head 18.

Figure 4:
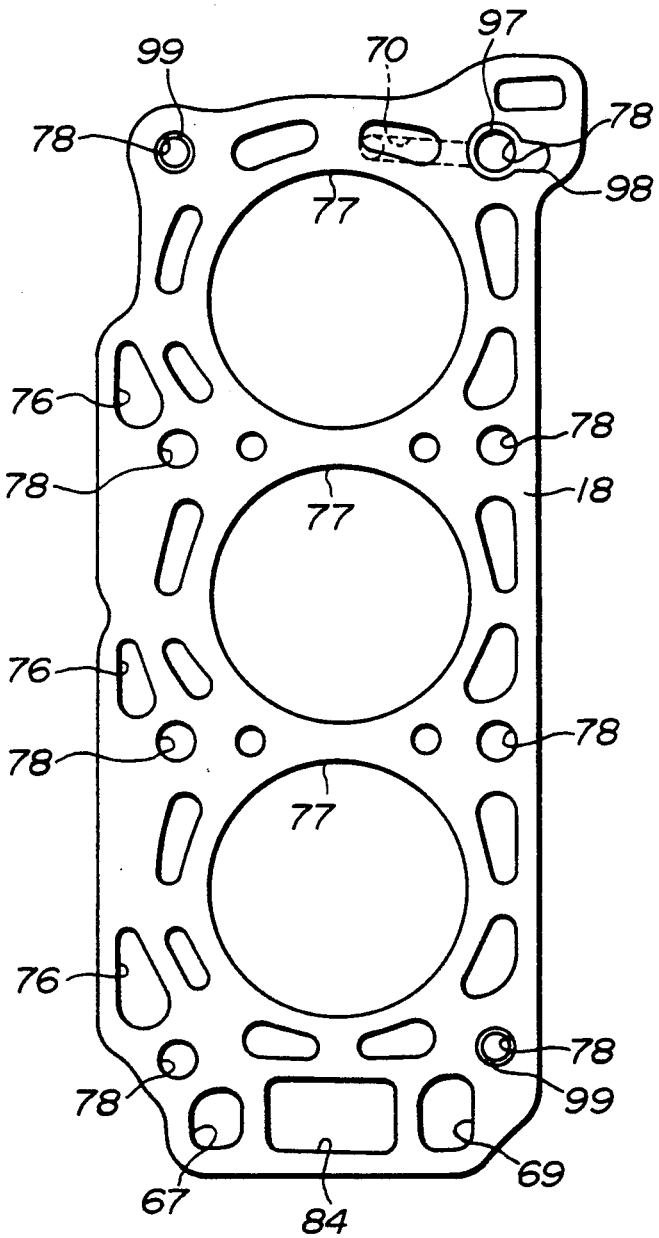
FIG. 4 is a bottom view of a cylinder head, showing a mating surface thereof for mating engagement with a cylinder block.

As shown in FIG. 4, the cylinder head 18 has combustion chambers 77, bolt insertion holes 78 and, coolant passages. FIG. 5 shows bolts 79 by which the cylinder head 18 is fastened to the cylinder block 14. The cylinder head 18 is positioned relative to the cylinder block 14 by knock pins 99. The cylinder head 18 also has a recess 98 defined laterally therein of a bolt insertion hole 78. The recess 98 is supplied lubricating oil from an oil passage (not shown) which is defined in the cylinder block 14 and open at the mating surface thereof which is held in mating engagement with the cylinder head 18. The lubricating oil is sent to the oil passage 70 from the recess 98 through an oil passage 97 around a bolt 79 which is inserted in the bolt insertion hole 78.

The lubricating oil is therefore returned from the crankshaft chamber 75 to the oil pan 42 through the lubricating oil return passageway thus defined.

An oil passage 81 is defined around the gears 34, 46 in the primary gear case 41. The primary gear case 41 has an oil passage 83 defined therein and extends from a bearing which supports the gear 36, the oil passage 83 opening into a space 82.

A lubricating oil return passageway from the valve operating mechanism chamber 21 to the oil pan 42 is defined as shown in FIG. 3.

More specifically, an oil passage 84 is defined in the cylinder head 18 below the camshaft 22 and opens into the valve operating mechanism chamber 22 (see FIG. 5). As shown in FIG. 4, the oil passage 84 opens at the mating surface of the cylinder head 18 held in mating contact with the cylinder block 14. The oil passage 84 is positioned between the oil passages 67, 69 which serve as inlet and outlet passages, respectively, for the oil pump 37.

As shown in FIG. 3, the oil passage 84 is connected to an oil passage 85 which is defined in the cylinder block 14 and open at the mating surface thereof held in mating engagement with the cylinder head 18. The oil passage 85 is also open at the lower surface of the cylinder block 14. The oil passage 85 communicates with an oil chamber 86 defined in the primary gear case 41 and has a lower opening to which a bottom plate 87 is fastened with a screw 88.

The bottom plate 87 has an oil return pipe 89 welded thereto. The oil suction pipe 64 (see FIG. 2) is coupled to and supported on a lower portion of the oil return pipe 89 by a stay 91. The oil return pipe 89 has an opening defined in the lower end thereof which is positioned closely to an opening in the oil filter 63 on the lower end of the oil suction pipe 64.

Figure 6:
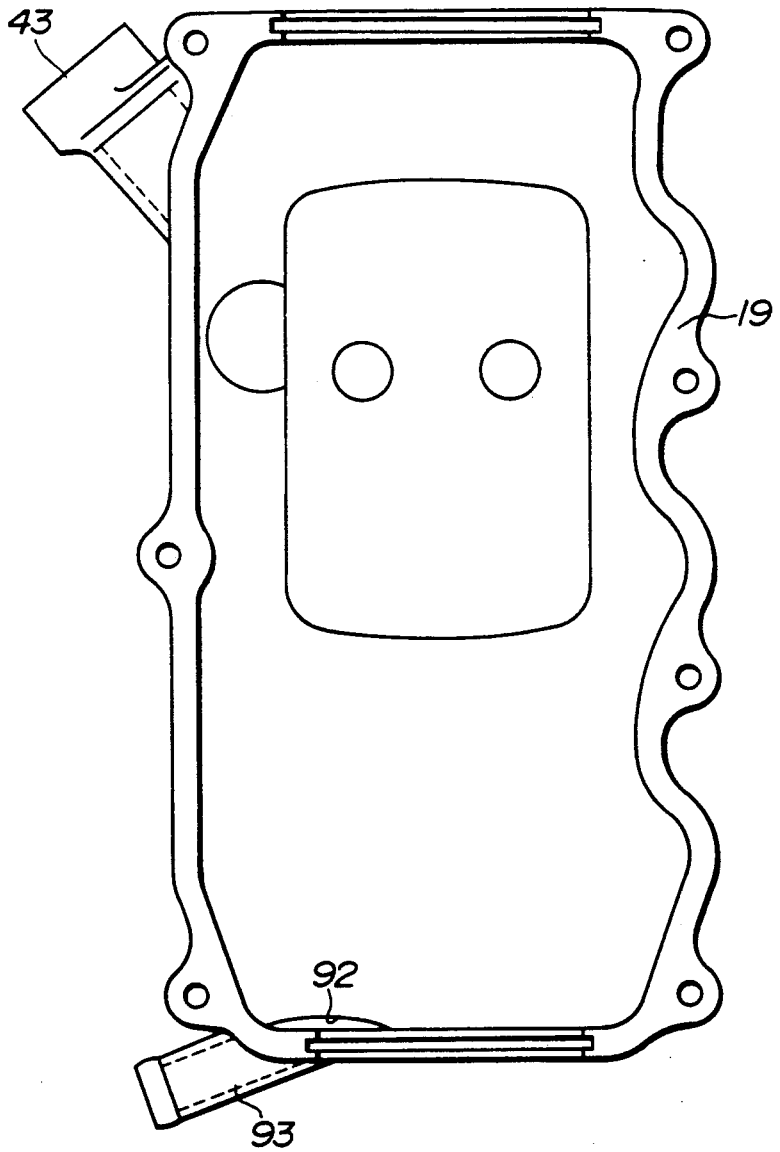
FIG. 6 is a bottom view of the cylinder head cover, showing the interior thereof.

As shown in FIG. 6, the head cover 19 has an oil passage 92 defined in a lower portion thereof and has an opening at an inner bottom surface thereof. The oil passage 92 communicates with an oil outlet pipe 93 which projects obliquely downwardly from an outer side of the head cover 19. To the oil outlet pipe 93, there is connected an oil hose 94 which is connected to an oil inlet pipe 95 communicating with the oil chamber 86 in the primary gear case 41.

The lubricating oil is returned from the valve operating mechanism chamber 21 to the oil pan 42 through the above lubricating oil return passageway.

Figure 7:
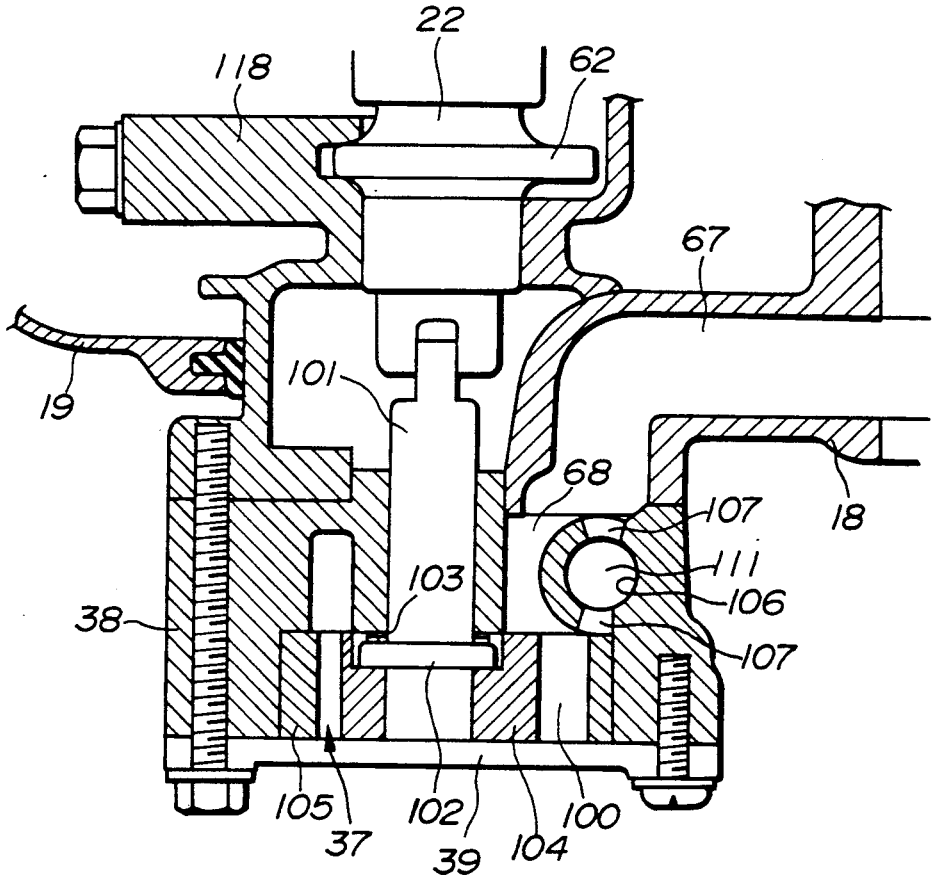
FIG. 7 is an enlarged fragmentary vertical cross-sectional view of an oil pump.
Figure 8:
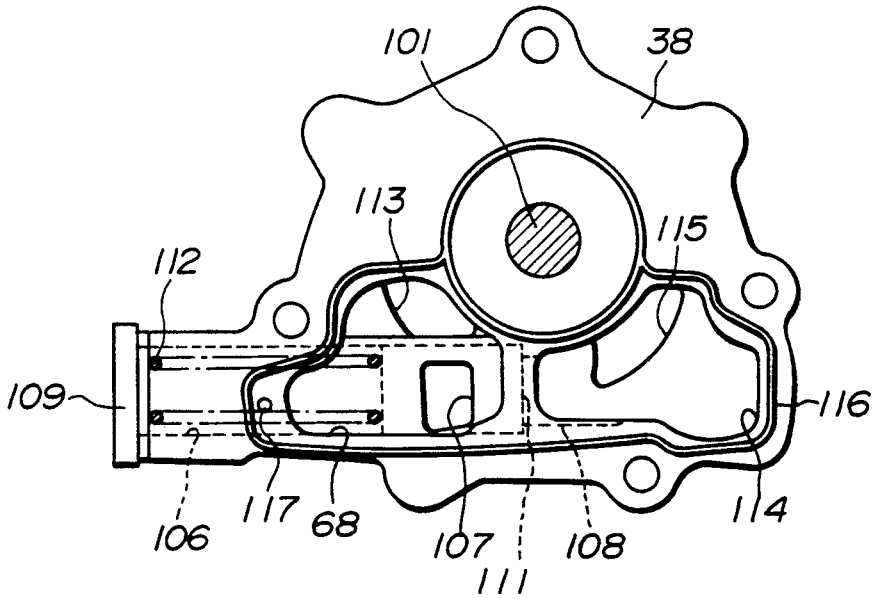
FIG. 8 is an enlarged plan view of a pump case of the oil pump.

The oil pump 37 will be described in greater detail with reference to FIGS. 7 and 8.

The oil pump 37 has a pump chamber 100 defined in the pump case 38, a pump drive shaft 101, and a retaining pin 102 on the pump drive shaft 101, a washer 103 on the pump drive shaft 101. The oil pump 37 also has an inner rotor 104 mounted on the pump drive shaft 101 and disposed in the pump chamber 100, an outer rotor 105 disposed around the inner rotor 104 in the pump chamber 100, a relief valve housing 106, two upper and lower suction oil relief holes 107 opening into the relief valve housing 106, and a discharge oil relief hole 108 defined at an axial end of the relief valve housing 106. The oil pump 37 also has an opening cover 109 covering the relief valve housing 106, an oil pressure relief valve 111 disposed in the relief valve housing 106, and a relief spring 112 for normally urging the oil pressure relief valve 111. The suction port 68 has an inlet 113 opening into the pump chamber 100. The oil pump 37 has an outlet port 114 which has an outlet 115 opening into the pump chamber 100. The oil pump 37 is coupled to the cylinder head 18 through a rubber gasket 116. The relief valve housing 106 has an air bleeder hole 117 which assists in moving the oil pressure relief valve 111 in the relief valve housing 106.

The eccentric cam 62 for actuating the fuel pump 51 doubles as a stopper for preventing the camshaft 22 from being axially displaced. To this effect, the eccentric cam 62 is held against axial movement by a holder 118 integral with the cylinder head 18 to which the pump case 38 is fastened.

The oil pressure relief valve 111 housed in the pump case 38 serves to release any excessive oil pressure from the outlet port 114 smoothly into the suction port 68.

As shown in FIG. 3, a coolant passage 119 is defined in the cylinder block 14 near the oil passage 85 in the lubricating oil return passageway, for preventing the primary gear case 41 from being excessively heated by the heat of the oil flowing through the oil passage 85.

The outboard engine assembly which includes the engine 11 with the above lubricating oil passage structure is mounted on a boat with the stern bracket 9 fixed to the stern of the boat. When the engine 11 operates and the bow of the boat is lifted under reactive forces produced by the propulsion developed by the propeller screw 1, the bottom of the valve operating mechanism chamber 21 which is located ahead of the horizontal cylinders 15 (i.e., behind the boat) is displaced into a lower position. Alternatively, when the outboard engine assembly is angularly moved about the axis P of the horizontal tilt shaft 8 through a certain tilt angle, the bottom of the valve operating mechanism chamber 21 is positioned lower than a horizontal straight line L (see FIG. 3) that passes through the axis P.

In addition to the return oil passage 84 defined in the cylinder head 18 and the opening at the bottom of the valve operating mechanism chamber 21, the return oil passage 92 is also defined in the lower portion of the head cover 19. The return oil passage 92 opening at the bottom of the valve operating mechanism chamber 21 is below the horizontal straight line L. The lubricating oil which has lubricated various components in the valve operating mechanism chamber 21 also flows through the oil passage 92 into the oil chamber 86, and then through the oil return pipe 89 back into the oil pan 42.

In the oil pan 42 containing lubricating oil, the lower end opening of the oil return pipe 89 is positioned closely to the opening of the oil filter 63 on the lower end of the oil suction pipe 64. Consequently, the suction pressure exerted by the oil pump 37 through the oil suction pipe 64 acts also in the opening of the oil return pipe 89, thereby helping and accelerating the return of lubricating oil from within the valve operating mechanism chamber 21.

Therefore, the lubricating oil is smoothly returned from the valve operating mechanism chamber 21 to the oil pan 42 at all times.

The oil suction pipe 64 and the oil return pipe 89 are not attached to the engine 11 independently of each other. Rather, the bottom plate 87 integral with the upper end of the oil return pipe 89 is fastened to the primary gear case 41 by the screw 88, and the oil suction pipe 64 is coupled to and supported on the lower portion of the oil return pipe 89 by the stay 91. Accordingly, the oil suction pipe 64 and the oil return pipe 89 can easily be assembled in place.

While the engine has been shown and described as being incorporated in an outboard engine assembly, the engine with the lubricating oil passage structure according to the present invention may be mounted on a lawn mower which is pushed by the user in operation. The engine according to the present invention may have any desired number of cylinders.

With the present invention, as described above, the engine with horizontal cylinders has a lubricating oil passage structure including lubricating oil return passage openings respectively into the cylinder head and the cylinder cover through the bottom of the valve operating mechanism chamber. Therefore, even when the engine in the form of a composite assembly including the cylinder block, the crankcase, the cylinder head, and the head cover is inclined to displace the distal ends of the horizontal cylinders into a lower position, the lubricating oil in the valve operating mechanism chamber can be returned to the oil pan from the lubricating oil return passage that opens into the head cover through the bottom of the valve operating mechanism chamber.

Furthermore, inasmuch as the openings of the oil suction pipe and the oil return pipe in the lubricating oil in the oil pan are positioned closely to each other, the suction pressure developed in the oil suction pipe by the oil pump also acts on the opening of the oil return pipe, so that the lubricating oil in the valve operating mechanism chamber can be returned to the oil pan at an accelerated rate under the applied suction pressure.

When the distal end regions of the horizontal cylinder of the engine are tilted obliquely downwardly under reactive forces produced upon the boat being propelled by the propeller screw 1, the lubricating oil, therefore can smoothly return from the valve operating mechanism chamber to the oil pan at all times.

Since the oil return pipe or the oil suction pipe may be fastened at its upper end to the engine body and the oil return pipe and the oil suction pipe are coupled to each other at their lower portions, these pipes may be easily joined to each other.

Although there have been described what are considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

We claim:

1. An engine comprising:

a cylinder block with at least one horizontal cylinder defined therein;

an oil pan disposed downwardly of said cylinder block;

a cylinder head coupled to said cylinder block;

a head cover coupled to said cylinder head;

a valve operating mechanism chamber defined jointly between said cylinder head and said head cover;

lubricating oil supply passage means for supplying lubricating oil from said oil pan to at least said valve operating mechanism chamber; and lubricating oil return passage means for returning lubricating oil from at least said valve operating mechanism chamber to said oil pan, said lubricating oil return passage means having openings for introducing lubricating oil from said valve operating mechanism chamber, said openings being defined in inner surfaces, respectively, of said cylinder head and said head cover which face a bottom of said valve operating mechanism chamber.

2. An engine according to claim 1, wherein said lubricating oil supply passage means comprises an oil suction pipe having an opening in said oil pan, and an oil pump for drawing lubricating oil from said oil pan through said oil suction pipe into said valve operating mechanism chamber, and said lubricating oil return passage means comprises an oil return pipe communicating with said openings and having an opening disposed closely to said opening of the oil suction pipe in said oil pan.

3. An engine according to claim 2, wherein one of said oil suction and return pipes is fastened by a screw to said cylinder block, said oil suction and return pipes being coupled to each other at lower portions thereof closely to the openings thereof.

4. An engine comprising:

a composite assembly defining at least one horizontal cylinder therein and having at least a crankshaft chamber and a valve operating mechanism chamber therein;

an oil pan disposed downwardly of said composite assembly, for being filled with lubricating oil;

said composite assembly having defined therein:

a first oil return passage held in communication with said oil pan, for returning lubricating oil from said crankshaft chamber to said oil pan, said first oil return passage having a first opening being defined in a bottom surface defining partly said crankshaft chamber; and a second oil return passage independent of said first oil return passage and held in communication with said oil pan, for returning lubricating oil from said valve operating mechanism chamber to said oil pan, said second oil return passage having a second opening being defined in a bottom surface defining partly said valve operating mechanism chamber closely to said crankshaft chamber, and a third opening being defined in a bottom surface defining partly said valve operating mechanism chamber remotely from said crankshaft chamber.

5. An engine according to claim 4, wherein said composite assembly comprises:

a cylinder block with said horizontal cylinder defined therein;

a crankcase coupled to said cylinder block, said crankshaft chamber being defined jointly between said cylinder block and said crankcase;

a cylinder head coupled to said cylinder block remotely from said crankcase;

a head cover coupled to said cylinder head, said valve operating mechanism chamber being defined jointly between said cylinder head and said head cover; and said first opening being open in inner bottom surfaces of said cylinder block and said crankcase which define said crankshaft chamber, said second opening being open in an inner bottom surface of said cylinder head which defines said valve operating mechanism chamber, and said third opening being open in an inner bottom surface of said head cover which defines said valve operating mechanism chamber.

6. An outboard engine assembly for being mounted on a boat for vertical angular movement about a tilt shaft, comprising:

an engine having at least a cylinder head and a head cover which define a valve operating mechanism chamber therebetween; and lubricating oil return passage means having openings for draining lubricating oil from said valve operating chamber said openings being defined respectively in inner surfaces of said cylinder head and said head covers which define said valve operating mechanism chamber jointly therebetween.

7. An outboard engine assembly according to claim 6, wherein said engine further comprises:

an oil pan disposed in a lowermost portion of the engine, for being filled with lubricating oil;

lubricating oil supply passage means having at least an oil suction pipe with a suction opening in said oil pan, for supplying lubricating oil from said oil pan to said engine; and said lubricating oil return passage means having an oil return passage with a return opening disposed in said oil pan closely to the suction opening of said oil suction pipe, for returning lubricating oil from said valve operating mechanism chamber through said openings to said oil pan.

8. An outboard engine assembly according to claim 7, wherein said engine further comprises a crankcase disposed most closely to said tilt shaft, and a cylinder block coupled to said crankcase, said cylinder block defining at least one cylinder with a distal end thereof directly rearwardly in a longitudinal direction of the boat, said cylinder head being coupled to said cylinder block remotely from said crankcase, said head cover being coupled to said cylinder head mostly remotely from said tilt shaft, said openings in said cylinder head and said head cover being open in the inner surfaces thereof which define a bottom of said valve operating mechanism chamber such that when the outboard engine assembly is angularly moved downwardly about said tilt shaft to position said opening in said head cover below a horizontal plane passing through said tilt shaft, said opening in said head cover introduces lubricating oil more smoothly than said opening in said cylinder head in order to allow said lubricating oil return passage means to function smoothly at all times during operation of said engine.

* * * * *